US007021291B2

(12) United States Patent
Denton et al.

(10) Patent No.: US 7,021,291 B2
(45) Date of Patent: Apr. 4, 2006

(54) JUNCTURE FOR A HIGH PRESSURE FUEL SYSTEM

(75) Inventors: James E. Denton, Columbus, IN (US); Anthony A. Shaull, Columbus, IN (US); Scott R. Simmons, Columbus, IN (US); Matthew B. State, Greenwood, IN (US); Todd M. Wieland, Bloomington, IL (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 10/743,823

(22) Filed: Dec. 24, 2003

(65) Prior Publication Data

US 2005/0144558 A1 Jun. 30, 2005

(51) Int. Cl.
*F02M 55/02* (2006.01)

(52) U.S. Cl. ..... 123/456; 123/468; 123/469

(58) Field of Classification Search ..... 123/456, 123/447, 468, 469, 470, 495
See application file for complete search history.

(56) References Cited

U.S. PATENT DOCUMENTS

| | | | | |
|---|---|---|---|---|
| 5,197,435 | A * | 3/1993 | Mazur et al. | 123/456 |
| 5,667,255 | A | 9/1997 | Kato | |
| 5,707,460 | A | 1/1998 | Chaterjee | |
| 5,979,945 | A | 11/1999 | Hitachi et al. | |
| 5,983,863 | A * | 11/1999 | Cavanagh et al. | 123/447 |
| 5,992,904 | A | 11/1999 | Hitachi et al. | |
| 6,050,611 | A | 4/2000 | Asada | |
| 6,083,455 | A | 7/2000 | Kurita et al. | |
| 6,223,726 | B1 * | 5/2001 | Jung et al. | 123/468 |
| 6,382,186 | B1 | 5/2002 | Kulovits et al. | |
| 6,405,709 | B1 | 6/2002 | Carroll, III et al. | |
| 6,520,155 | B1 * | 2/2003 | Boecking | 123/456 |
| 6,612,289 | B1 * | 9/2003 | Frank et al. | 123/456 |
| 6,637,407 | B1 * | 10/2003 | Boecking | 123/456 |
| 2005/0005910 | A1 * | 1/2005 | Usui et al. | 123/456 |

FOREIGN PATENT DOCUMENTS

| | | |
|---|---|---|
| JP | 07-286256 | 10/1995 |
| JP | 2002-241922 | 8/2002 |
| WO | WO 01/25615 A1 * | 4/2001 |
| WO | WO 01/25617 A1 * | 4/2001 |

* cited by examiner

*Primary Examiner*—Thomas Moulis
(74) *Attorney, Agent, or Firm*—Nixon Peabody LLP; Tim L. Brackett, Jr.; J. Bruce Schelkopf

(57) ABSTRACT

A juncture and method for changing direction of fuel flow in a high pressure fuel injection system such as a common rail and/or a fuel pump, the juncture comprising a body, a first passage formed in the body having a first diameter and a longitudinal axis extending therethrough, the first passage including a groove positioned along a portion of the longitudinal axis, and a second passage formed in the body having a second diameter, a central axis extending therethrough, and an opening, the opening of the second passage being provided in the groove of the first passage to allow fluidic communication between the second passage and the first passage so that stresses at the juncture caused by high pressure fuel changing direction of flow is reduced.

29 Claims, 6 Drawing Sheets

JUNCTURE FOR A HIGH PRESSURE FUEL SYSTEM

BACKGROUND OF THE INVENTION

1. Field of the Invention

The present invention is directed to a mechanism and method for reducing likelihood of fatigue failure in a high pressure fuel system. In particular, the present invention is directed to a specific juncture geometry that may be utilized in high pressure pump and/or common fuel rail systems.

2. Description of Related Art

With the advent of increased fuel economy and reduced emissions requirements imposed by the government, various fuel systems have been developed to precisely control the amount of fuel that is injected during the injection events of a combustion cycle. In particular, high pressure fuel injection systems have been developed which provide increased control of the fuel injected by the fuel injectors of an internal combustion engine in comparison to conventional fuel injection systems.

Such high pressure fuel injection systems typically utilize at least one high pressure pump that pressurizes the fuel to be injected by the fuel injectors. Fuel systems may utilize a plurality of such pressure pumps corresponding to the number of fuel injectors, each of the pumps providing highly pressurized fuel to a fuel injector. Other fuel systems utilize fewer high pressure pumps in conjunction with a high pressure common rail. In such implementations, one or more high pressure pumps are connected to the high pressure common rail to thereby provide highly pressurized fuel to the fuel injectors of the internal combustion engine. The common rail then distributes the pressurized fuel to each of the fuel injectors.

A limitation of such high pressure fuel injection systems briefly described above has been found in that the high pressures of the pressurized fuel, which in certain instances, reach up to 30,000 p.s.i. or higher, for example, can cause fatigue failure in the various components of the fuel injection system. In particular, the rapid stress cycling of the high pressure pump and/or the common rail at these high pressures can cause the fuel passages in the fuel injection system to fail due to fatigue. Such fatigue failure has been found to be especially pronounced in the junctures of the fuel passages in which the direction of the fuel flow is changed or otherwise distributed. For example, fatigue failure has been observed occurring near the junction for a branch connector in the common rail at which the passages for each of the injectors are connected to the common rail. A similar type of fatigue failure has also been observed in high pressure pumps and fuel passages that are associated therewith where the direction of the fuel is changed or otherwise distributed.

To address the above identified problems associated with high pressure fuel systems, a novel mechanism and method for reducing fatigue failure in a high pressure pump and common rail fuel system has been proposed in the art. For example, U.S. Pat. No. 5,979,945 issued to Hitachi et al. discloses a common rail including a pipe connecting arrangement including an intersection of a smaller diameter hole with a larger diameter hole, the geometry of the holes being configured using various different designs to improve the strength of the pipe connecting arrangement as well as resistance against internal pressure fatigue. The Hitachi et al. reference also discloses that in one geometry of the branch connector, the axes of the two holes are offset relative to each other so that the axes do not intersect.

Moreover, various materials, as well as materials treated in accordance with various treatment processes, have been found to be appropriate for use in fuel injection valve bodies. For example, Japanese Patent 2002-241922A issued to Yasusaka discloses a fuel injection valve body consisting of a high alloy steel containing 5 to 6% Cr, 1.0 to 1.3% Mo, and ≧0.1 V. The reference also discloses that the fuel injection valve body is treated by gas nitriding to thereby provide a strong and dense layer consisting of $Fe_3N$, and a nitrided diffusion layer having a highly nitrided hardness. The reference notes that improvement in durability and pressure resistance can be obtained.

Despite the improvements in resisting fatigue failures as described by the Hitachi et al. reference, further improvements are desirable to further increase durability of high pressure fuel systems. In particular, a mechanism and method for improving fatigue failure resistance in a high pressure pump and/or common rail is desirable to further enhance the durability of high pressure fuel systems utilizing such components.

SUMMARY OF THE INVENTION

In view of the foregoing, one aspect of the present invention is a mechanism for reducing the likelihood of fatigue failure in a high pressure fuel system.

Another aspect of the present invention is a method for reducing the likelihood of fatigue failure in a high pressure fuel system.

In accordance with one example embodiment, the present invention utilizes a specific juncture geometry for reducing fatigue failure. More specifically, a juncture for changing direction of fuel flow in a high pressure fuel injection system is provided, the juncture comprising a body, a first passage formed in the body having a first diameter and a longitudinal axis extending therethrough, the first passage including a groove positioned along a portion of the longitudinal axis, and a second passage formed in the body having a second diameter with a central axis extending therethrough and an opening, the opening of the second passage being provided in the groove of the first passage to allow fluidic communication between the second passage and the first passage.

In accordance with one embodiment, the groove peripherally circumscribes at least a portion of the first passage. In another embodiment, the first passage is substantially circular in cross section and the groove is annular in shape, the groove having a groove diameter larger than the first diameter of the first passage. In addition, in another embodiment, the groove is provided with a dished curvature.

In still another embodiment, the opening of the second passage is transversely offset in the groove so that the central axis of the second passage does not intersect the longitudinal axis of the first passage. In yet another embodiment, the second passage is a plurality of second passages, each having an opening that is positioned in the groove. In this regard, the plurality of passages being transversely offset in the groove with respect to the first passage.

In one embodiment, the juncture is made of an alloy steel comprising at least one of chromium, molybdenum, and vanadium, the alloy steel being treated through a heat treatment cycle to provide a hardened martensitic core, and gas nitrided to provide a surface with enriched nitrogen content and hard surface layer having residual compressive stresses. For example, the juncture may be made of an alloy steel comprising by weight, up to 5.5% chromium, 1.5% molybdenum, and/or 1.0% vanadium, the alloy steel being treated through a heat treatment cycle to provide a hardened martensitic core, and gas nitrided to provide a surface with enriched a surface with enriched nitrogen content and hard surface layer having residual compressive stresses.

In accordance with one implementation, the high pressure fuel system is implemented with a common rail, the juncture of the present invention being provided in the common rail. In accordance with another implementation, the high pressure fuel injection system includes at least one high pressure pump, the juncture of the present invention being provided in the high pressure pump.

In accordance with another aspect of the present invention, a common rail is provided for distributing high pressure fuel to fuel injectors of an internal combustion engine, the common rail comprising a common rail body, a first passage formed in the common rail body, the first passage having a first diameter and a longitudinal axis extending therethrough, the first passage including a groove positioned along a portion of the longitudinal axis of the first passage, and a second passage formed in the common rail body, the second passage having a second diameter, a central axis extending therethrough, and an opening, the opening of the second passage being provided in the groove of the first passage to allow fluidic communication between the second passage and the first passage.

Yet another aspect of the present invention is a high pressure fuel pump for providing high pressure fuel to a fuel injector of an internal combustion engine, the high pressure fuel pump comprising a fuel pump body, a first passage formed in the fuel pump body, the first passage having a first diameter and a longitudinal axis extending therethrough, the first passage including a groove positioned along a portion of the longitudinal axis of the first passage, and a second passage formed in the fuel pump body, the second passage having a second diameter, a central axis extending therethrough, and an opening, the opening of the second passage being provided in the groove of the first passage to allow fluidic communication between the second passage and the first passage.

In accordance with yet another aspect of the present invention, a method for increasing resistance to fatigue failure is provided for a juncture of a high pressure fuel injection system that is adapted to change direction of fuel flow in the high pressure fuel injection system, the method comprising the steps of providing a body, providing a first passage in the body, the first passage having a longitudinal axis extending therethrough, providing a groove positioned along a portion of the longitudinal axis of the first passage, providing a second passage in the body, the second passage having an opening, and providing the opening of the second passage in the groove positioned on the first passage to allow fluidic communication between the second passage and the first passage.

In another embodiment, the method further includes the step of offsetting the opening of the second passage on a circumference of the groove so that a central axis of the second passage does not intersect the longitudinal axis of the first passage. In further including the step of providing another second passage in said body having an opening that is also positioned in said groove. In still another embodiment, the method further includes the step of positioning the second passages transversely offset in said groove and opposite to one another. In another embodiment, the method also includes the step of heat treating the juncture to provide a hardened martensitic core. In yet another embodiment, the method further includes the step of gas nitriding the juncture to provide a surface with enriched nitrogen content and hard surface layer thereon.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENT

Figure 1A:
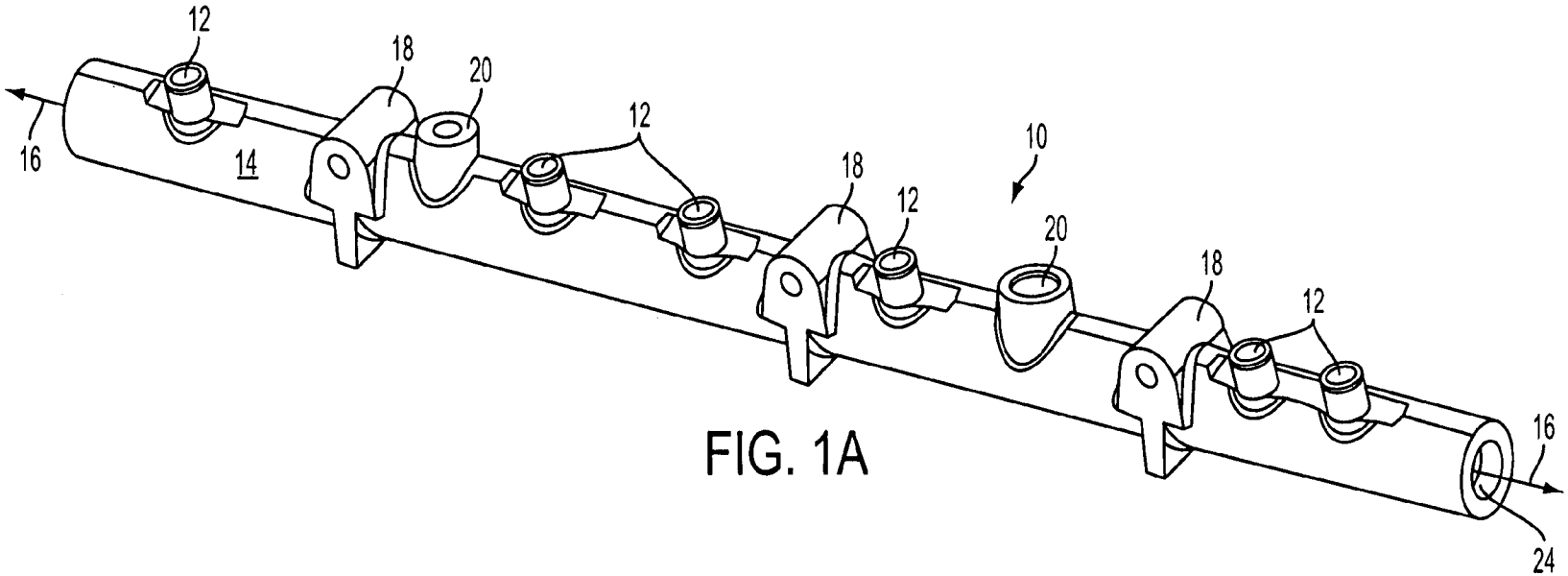
FIG. 1A is a perspective view of a common rail of a high pressure fuel injection system which includes a juncture in accordance with one embodiment of the present invention.
Figure 1B:
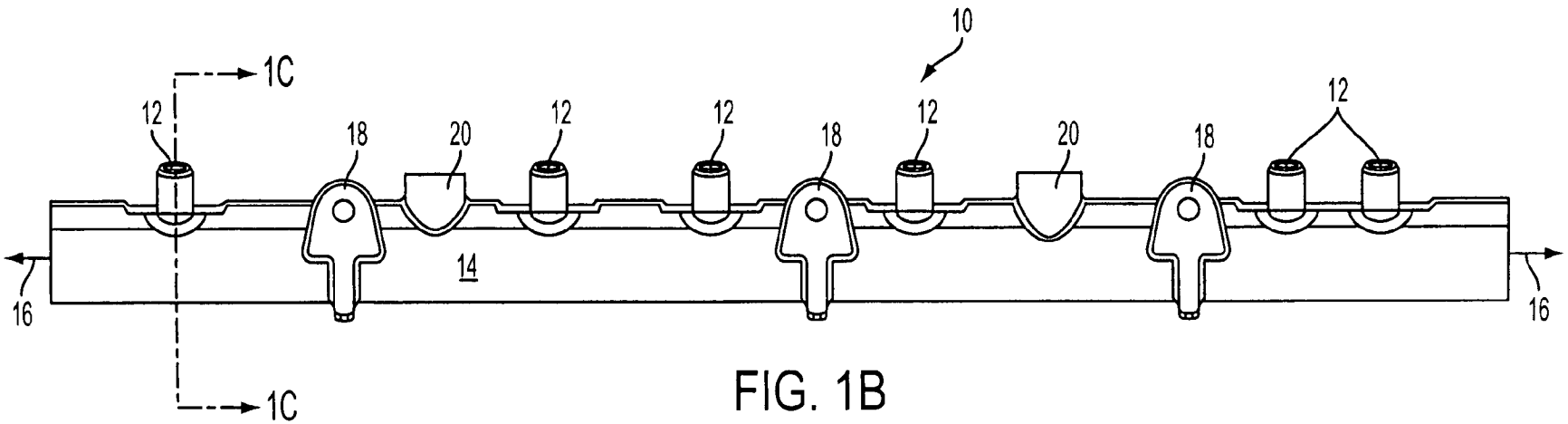
FIG. 1B is a side profile view of the common rail of FIG. 1A.

FIGS. 1A and 1B show perspective and profile views of a common rail 10 used in a high pressure fuel system of an internal combustion engine (not shown), the common rail 10 including a plurality of connectors 12 that have junctures in accordance with one embodiment of the present invention. The common rail 10 is adapted to receive pressurized fuel from a fuel pump (not shown) of the high pressure fuel system, and to distribute the pressurized fuel to a plurality of fuel injectors (not shown) that are fluidically connected to the junctures of connectors 12.

As described in detail below, the junctures in accordance with the present invention reduces the stresses caused by the rapid pressure cycling that occurs within the common rail 10 by the pressurized fuel, thereby reducing the likelihood of fatigue failure of the juncture. It should be noted that as used herein, the term "juncture" generally refers to the intersection of two or more passages in fluidic communication to allow distribution of fluid or to change the direction of flow of the fluid. Of course, passages are typically provided or otherwise formed in a structure such as a body of a component, pipes, and fluid lines, etc. Consequently, it should be understood that as used herein, the term "juncture" should be understood to refer to how the passages intersect with one another, and the geometry associated thereto.

The common rail 10 of the illustrated embodiment in FIGS. 1A and 1B is of the elongated rail type having a substantially tubular common rail body 14 with a longitudinal axis 16 extending through a first passage 24 that is formed in the body 14. A plurality of mounting bosses 18 are integrally formed on the body 14 to allow secure mounting of the common rail 10 to a mounting bracket or other components of the fuel system and/or the engine. In addition, access bores 20 are also integrally formed on the body 14 of the common rail 10 to allow fluidic communication between the first passage 24 of the common rail, and various components that are associated with the high pressure system for supplying and/or regulating the fuel in the common rail 10. For example, a supply line (not shown) may be connected to one of the access bores 20 for providing pressurized fuel from the fuel pump to the common rail 10. In addition, a pressure damper (not shown) may be connected to one of the access bores 20 to minimize the magnitude of pressure cycling by the fuel in the common rail 10. Of course, other components such as a pressure regulator (not shown) may be connected to the common rail 10 as well.

The pressure cycling of the common rail 10 which may result in fatigue failure of the common rail 10, is caused by the cyclically pressurizing of the fuel in the common rail 10 by the fuel pump of the high pressure fuel system. This pressurization of the fuel in the common rail 10 by the fuel pump causes periodic pressure spikes within the common rail 10 which can cause the common rail 10 to eventually fail due to fatigue. In addition, the pressure cycling of the common rail 10 is also exacerbated by the operation of the injectors during which the fuel in the common rail 10 is injected for combustion, the injection event causing periodic pressure dips in the fuel pressure in the common rail 10 which is replenished by the fuel pump of the high pressure fuel system. These injection events further increase the magnitude of the cycling pressure in the common rail 10 and further contribute to the eventual onset of fatigue failure.

As previously described, such fatigue failure has been found to be especially pronounced at the junctures of the fuel passages in which the direction of the fuel flow is changed or otherwise distributed. For example, fatigue failure has been observed occurring near the juncture of conventional common rail designs at which the passages for each of the injectors are connected to the common rail. Furthermore, fatigue failures have also been observed in fuel passages of high pressure pumps where the direction of the fuel is changed or otherwise distributed.

Figure 1D:
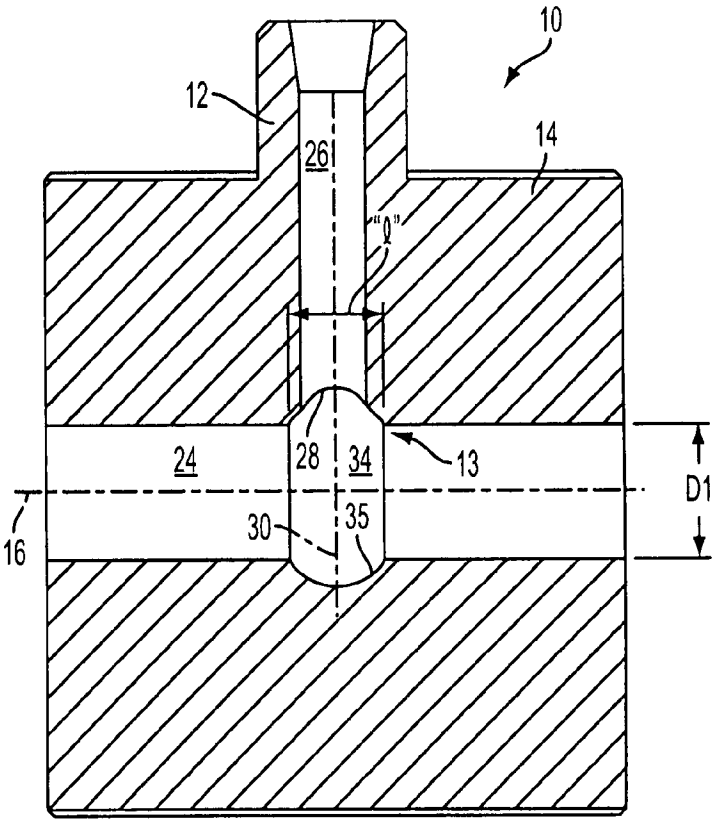
FIG. 1D is a longitudinal cross sectional view of the juncture of FIG. 1C as viewed along 1D—1D that more clearly illustrates the groove.
Figure 1C:
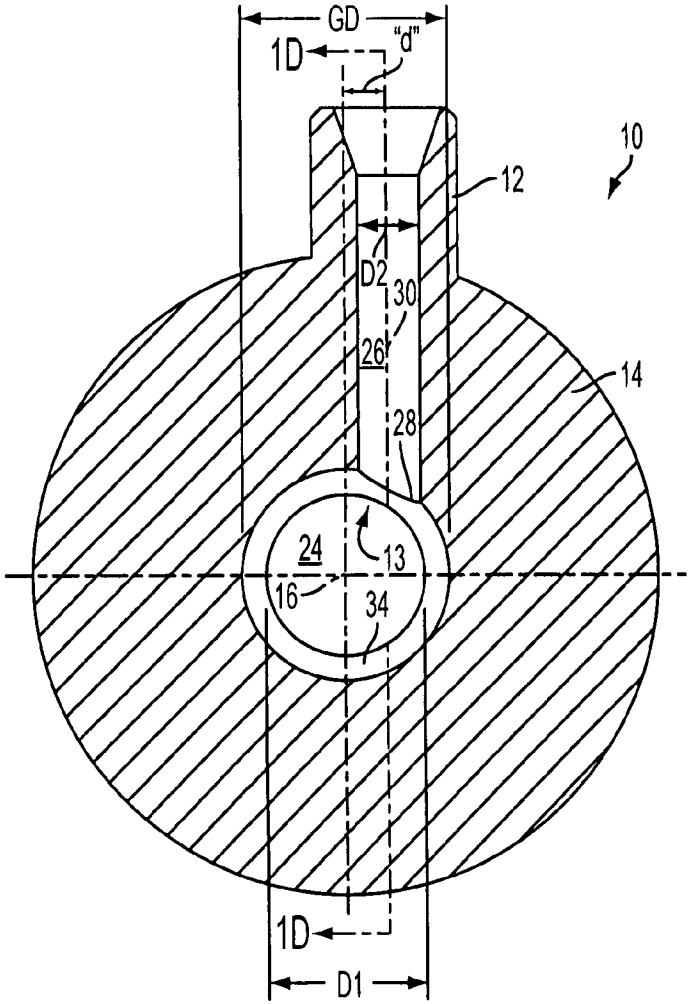
FIG. 1C is an axial cross sectional view of a juncture in the common rail of FIG. 1B as viewed along 1C—1C in accordance with one example implementation.

FIG. 1C is an axial cross sectional view of one of the connectors 12 provided in the common rail 10 of FIG. 1B as viewed along 1C—1C that more clearly shows the juncture 13 in accordance with the present invention. It should be noted that FIG. 1C merely shows one example embodiment of the juncture 13. As can be seen, the juncture 13 is integrally formed on the body 14 of the common rail 10 and is defined by the first passage 24 that substantially extends the length of the common rail 10, and a second passage 26, the longitudinal axis 16 extending through the first passage 24.

The pressurized fuel is distributed to the connector 12 from the first passage 10 via the second passage 26, the intersection of the first passage 24 and the second passage 26 defining the juncture 13 in the illustrated embodiment. In this regard, the second passage 26 includes an opening 28 that provides fluidic communication between the first passage 24 and the second passage 26. The second passage 26 includes a central axis 30 that extends therethrough. As can be seen, the first passage 24 and the second passage 26 are both implemented to have circular cross sections in the illustrated embodiment. Thus, the first passage 24 has a first diameter D1 and the second passage 26 has a second diameter D2, the first diameter D1 being larger than the second diameter D2 in the present example.

As can be clearly seen in the cross sectional view of FIG. 1C, the second passage 26 and its opening 28 are positioned transversely offset relative to the first passage 24. Thus, the central axis 30 extending through the second passage 26 does not intersect the longitudinal axis 16 extending through the first passage 24. In this regard, in the illustrated embodiment, the central axis 30 is transversely offset from the longitudinal axis 16 by distance "d".

FIG. 1D is a longitudinal cross sectional view of the juncture of FIG. 1C as viewed along 1D—1D that more clearly illustrates the groove 34 of present example implementation of the present invention. As clearly shown, the first passage 24 includes a groove 34 positioned along a portion of the longitudinal axis 16, the opening 28 of the second passage 26 being provided in the groove 34 and providing fluidic communication between the second passage 26 and the first passage 24. The groove 34 peripherally circumscribes at least a portion of the first passage 24.

In the above regard, because the first passage 24 has a circular cross section with a first diameter D1, the groove 34 is annular in shape, the groove 34 having a groove diameter GD shown in FIG. 1C which is larger than the first diameter D1 of the first passage 24. In addition, in the illustrated embodiment, the groove 34 extends the distance of "l" along the longitudinal axis 16 of the first passage 24, the distance l being greater than the diameter of the second passage 26. Furthermore, the groove 34 as shown, is provided with a dished curvature 35 that is concaved toward longitudinal axis 16 so that the periphery of the groove 34 generally resembles a torus.

Of course, FIGS. 1C and 1D merely illustrate one exemplary geometry of the groove 34 and the present invention is not limited thereto, but may be implemented to have a different geometry in other embodiments. For example, the passages need not be circular, but may be substantially elliptical or a different shape. In addition, the periphery of the groove 34 need not be provided with the dished curvature 35, but may be substantially linear so as to be parallel with the surface of the first passage 24. Moreover, the groove 34 may only extend a distance same as the diameter of the second passage 26. However the above described geometry and configuration has been found to effectively reduce likelihood of fatigue failure with easier manufacturability.

Thus, in accordance with the present invention, a mechanism for reducing the likelihood of fatigue failure in a high pressure fuel system is provided. In particular, a juncture 13 for changing the direction of fuel flow or distribution of fuel is provided which may be implemented in a common rail 10 such as that shown in FIG. 1A. By providing a groove 34 in the first passage 24 in which the opening 28 of the second passage 26 is positioned, the stresses present at the juncture 13 that are caused by the pressure cycling has been found to be reduced. Thus, the likelihood of fatigue failure is also reduced as compared to conventional junctures in which the second passage is directly connected to the first passage without a groove. Moreover, by transversely offsetting the position of the second passage 26 relative to the first passage 24 so that the central axis 30 of the second passage 26 does not intersect the longitudinal axis 16 extending through the first passage 24, the likelihood of fatigue failure is further reduced.

In the illustrated embodiment, the body 14 of the common rail 10, and thus, the juncture 13 provided therein, is made of an alloy steel of chromium, molybdenum, and/or vanadium. For example, the juncture may be made of an alloy steel comprising by weight, up to 5.5% chromium, 1.5% molybdenum, and/or 1.0% vanadium. The alloy steel is preferably treated through a heat treatment cycle to provide a hardened martensitic core, and gas nitrided to provide a surface with enriched nitrogen content and hard surface layer having residual compressive stresses. This alloy steel and treatment thereof, has been found to be very effective in reducing the likelihood of fatigue failure, especially in combination with the juncture of the present invention as described above. Of course, in other embodiments, other materials and/or treatments may be used.

Figure 2A:
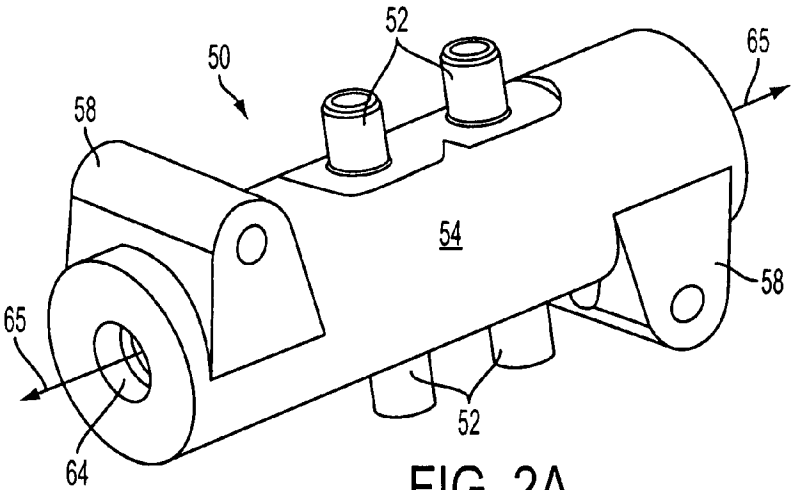
FIG. 2A is a perspective view of another common rail used in a high pressure fuel injection system which includes a juncture in accordance with one embodiment of the present invention.
Figure 2C:
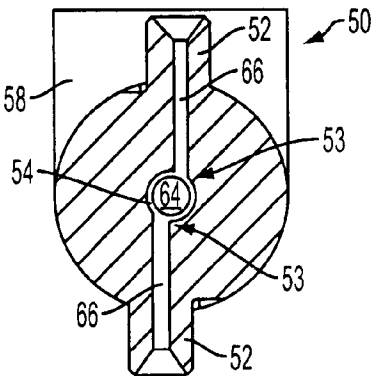
FIG. 2C is a cross sectional view of two junctures in the common rail of FIG. 2B as viewed along 2C—2C.
Figure 2B:
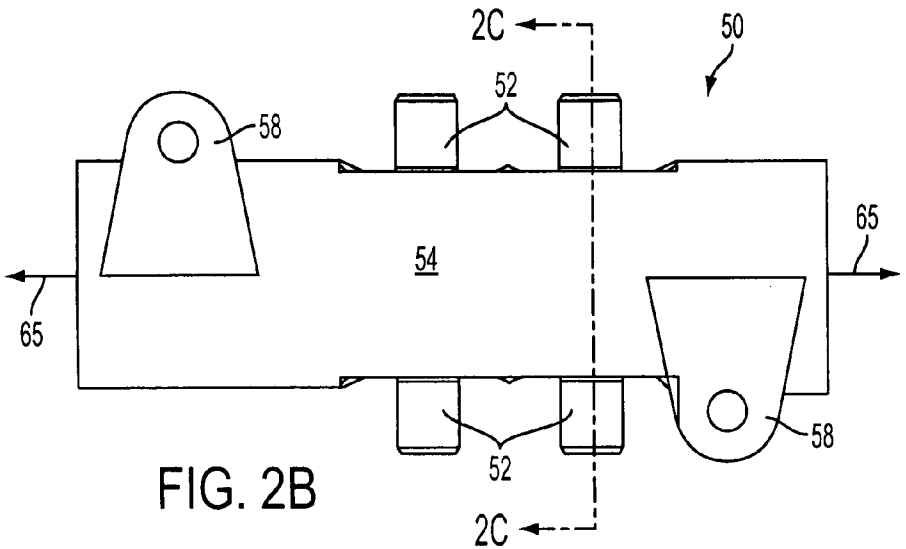
FIG. 2B is a side profile view of the common rail shown in FIG. 2A.

FIGS. 2A and 2B show perspective and side profile views of another type of common rail 50 used in a high pressure fuel injection system. The common rail 50 is a stubby type having a shortened tubular common rail body 54 which includes a plurality of connectors 52 having junctures in accordance with another embodiment of the present invention. The common rail 50 is adapted to receive pressurized fuel, and to distribute the pressurized fuel to a plurality of fuel injectors (not shown) via the connectors 52. The body 54 of the common rail 50 has a plurality of mounting bosses 58 to allow mounting of the common rail 50.

The body 54 of the common rail 50 is formed with a first passage 64 with a longitudinal axis 65 extending therethrough, and second passages 66 (in this example, two second passages 66) positioned in each of the connectors 52, the intersection of the first passage 64 and the second passages 64 defining the junctures that fluidically connect the passages together. In this regard, each of the second passages 66 are fluidically connected to the first passage 64 in a manner shown in FIG. 2C in accordance with the illustrated embodiment discussed in further detail below to thereby provide junctures 53.

As shown in these figures, the connectors 52 are provided in pairs, each connector 52 being positioned substantially diametrically opposed to another connector 52 on the body 54. In accordance with the present embodiment invention, each of the junctures 53 fluidically connect the second passages 66 to the first passages 64 via groove 54 provided in the first passage 64. In this regard, the openings of the junctures 53 are provided in the groove 54 on substantially opposing manner. As can also be seen, the second passages 66 are positioned transversely offset relative to the first passage 64 so that the central axis extending through the second passages 66 do not intersect the longitudinal axis 56. Thus, in the illustrated embodiment, the second passages 66 are substantially diametrically opposed, but also transversely offset.

Of course, in other embodiments, the second passages need not be configured diametrically opposed to each other and the second passages 66 may be configured in any appropriate manner. For example, the second passages may be positioned at an angle with respect to each other, or pass substantially straight through the first passage so that the second passages are not diametrically opposed, but are instead, positioned toward one side of the first passage. In still other implementations, even greater number of passages such as three, four, or even more passages may intersect the first passage, these plurality of passages being fluidically connected to the first passage via a groove provided therein in the manner taught and described herein.

Referring again to FIGS. 2B and 2C, it should be evident that two annular grooves are provided along the first passage 64 of the fuel pump component 50. In particular, two annular grooves are positioned longitudinally along the longitudinal axis 56 corresponding to the position of each pair of diametrically positioned junctures 53 (one groove being shown in FIG. 2C and the other groove not being shown).

In the illustrated embodiment, the fuel pump component 50 and correspondingly the junctures 53 provided therein, may be made of an alloy steel containing by weight, up to 5.5% chromium, 1.5% molybdenum, and/or 1.0% vanadium, which is preferably heat treated and gas nitrided as described previously relative to the common rail. Of course, as previously noted, other materials and treatments may be used.

It should further be noted that whereas in the embodiments described above, the juncture for reducing fatigue failure has been applied to connectors of a common rail for a high pressure fuel system, the present invention is not limited thereto. In this regard, the present invention may be effectively implemented to any junctures of fuel passages such as in a high pressure pump, fuel injectors, and/or common rail fuel system in which the direction of the fuel flow is changed or otherwise distributed.

Figure 3B:
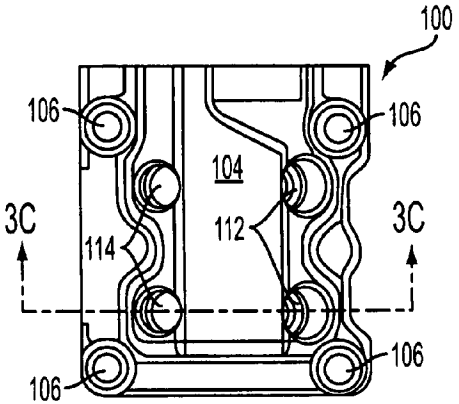
FIG. 3B is a topographical view of the fuel pump component shown in FIG. 3A.
Figure 3D:
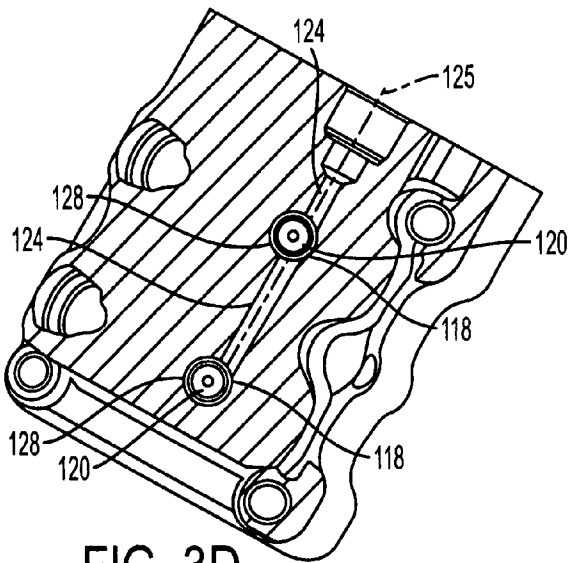
FIG. 3D is a cross sectional view of a juncture in the fuel pump component of FIG. 3C as viewed along 3D—D.
Figure 3A:
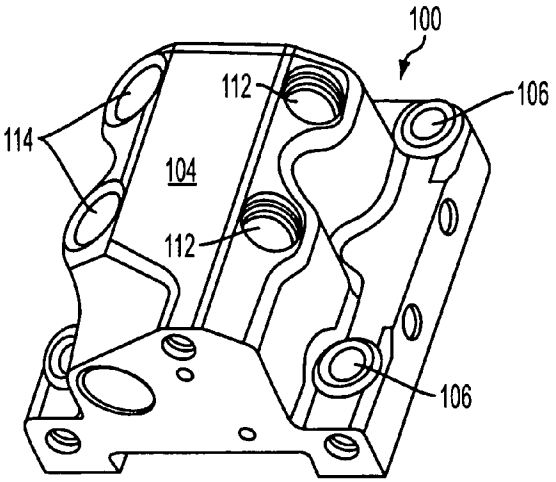
FIG. 3A is a perspective view of a fuel pump component used in a high pressure fuel injection system which includes a juncture in accordance with one embodiment of the present invention.

FIG. 3A is a perspective view of a fuel pump component 100 of a high pressure fuel injection system, the fuel pump component 100 including a juncture in accordance with another embodiment of the present invention. It should be evident that the fuel pump component 100 shown is merely a single component of a fuel pump assembly (not shown). For example, the fuel pump component 100 shown is a fuel distribution housing having a v-head design which is adapted to distribute pressurized fuel to a common rail.

Referring also to FIG. 3B which is a topographical view of the fuel pump component 100 shown in FIG. 3A, the fuel pump component 100 includes a fuel pump body 104 having a plurality of mounting bosses 106 that allow the fuel pump component 100 to be installed, for example, to the rest of the fuel pump assembly. The fuel pump component 100 also includes a plurality of ports 114 for providing fluidic access to the fuel pump component 100, and plurality of connectors 112 that include junctures of the present invention as described in further detail below. The illustrated connectors 112 allow fluidic connection to the common rail of the fuel system thereby allowing distribution of pressurized fuel.

Figure 3C:
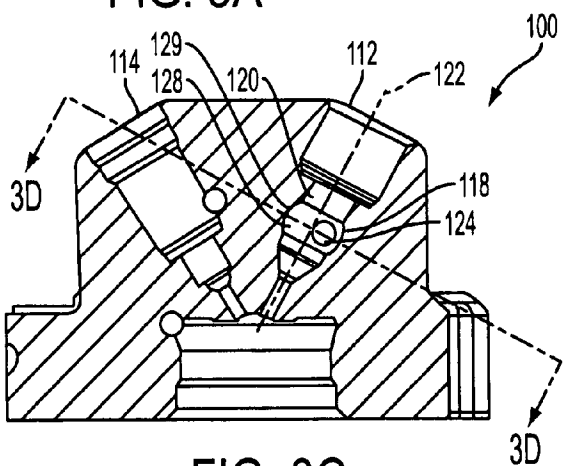
FIG. 3C is a cross sectional view of a juncture in the fuel pump component of FIG. 3B as viewed along 3C—C.

FIGS. 3C and 3D show cross sectional views of the connectors 112 that clearly illustrates junctures 118 in the fuel pump component 100 which are implemented in accordance with one embodiment of the present invention. As can be seen, the connectors 112 of the fuel pump component 100 includes a first passage 120 having a longitudinal axis 122 extending therethrough. The body 104 of the fuel pump component 100 is also provided with a second passage 124 having a central axis 125 extending therethrough, the second passage 124 fluidically communicating with the first passages 120 to thereby define junctures 118.

As also shown, the first passages 120 of the fuel pump component 100 are provided with grooves 128 in which the second passage 124 is positioned so that the first passages 120 and the second passage 124 fluidically communicate with one another via the grooves 128. In addition, in the manner previously described relative to the common rails and as most clearly shown in FIG. 3D, the second passage 124 is positioned offset relative to the first passages 120 so that the central axis 125 extending through the second passage 124 does not intersect the longitudinal axis 122 of the first passages 120. Furthermore, the second passage 124 passes substantially straight through the first passage 120 so that the segments of the second passage are not diametrically opposed, but are instead, positioned toward one side of the first passage 130.

In the illustrated example, the grooves 128 are annular in shape since the first passages 120 have a circular cross section. Furthermore, the grooves 128 have a torus shape so that the outer periphery includes a dished curvature 129. Moreover, the diameter of the first passage 120 is larger than the diameter of the second passage 124. Of course, in other implementations, the junctures 118 and/or passages may have different geometries as well.

Thus, in accordance with the above described aspect of the present invention, a mechanism for reducing fatigue failure in a high pressure fuel pump is provided. By providing a groove 128 in the first passages 120 in which the opening to the second passage 124 is positioned, the stresses at the junctures 118 are reduced as compared to conventional junctures, correspondingly resulting in the reduction of the likelihood of fatigue failure. Moreover, by offsetting the positioning of the second passage 124 relative to the first passages 120 so that the central axis 125 of the second passage 124 does not intersect the longitudinal axis 122, further reduction in the likelihood of fatigue failure is attained.

The fuel pump component 100 and correspondingly, the junctures 118 provided therein, may be made of an alloy steel containing by weight, up to 5.5% chromium, 1.5% molybdenum, and/or 1.0% vanadium which is preferably heat treated and gas nitrided as described previously relative to the common rail. Such treated alloy steel has been found to be very effective in reducing the likelihood of fatigue failure when used in combination with the juncture of the present invention.

Figure 4B:
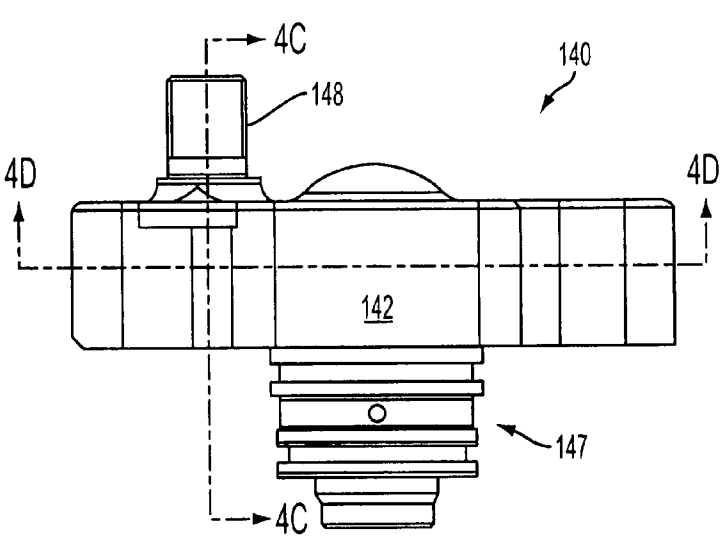
FIG. 4B is a side view of the fuel pump component shown in FIG. 4A.
Figure 4D:
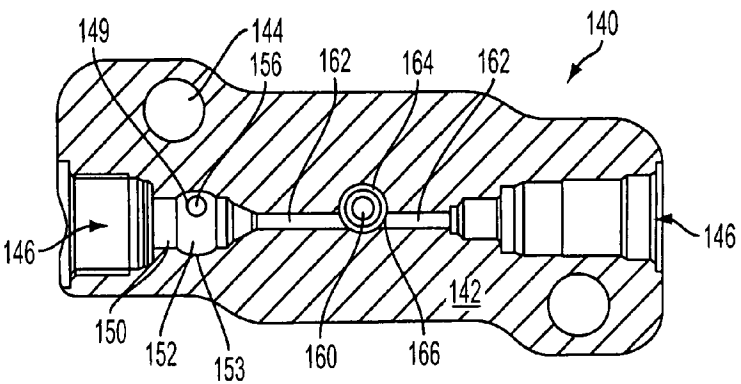
FIG. 4D is a cross sectional view of a juncture in the fuel pump component of FIG. 4B as viewed along 4D—4D.
Figure 4A:
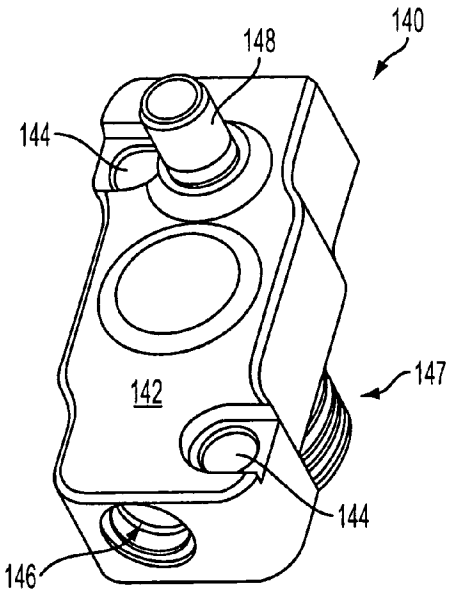
FIG. 4A is a perspective view of another fuel pump component used in a high pressure fuel injection system which includes a juncture in accordance with another embodiment of the present invention.
Figure 4C:
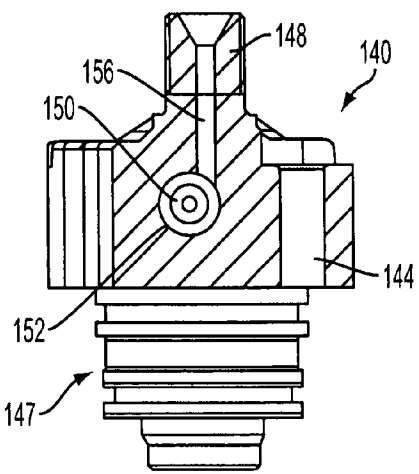
FIG. 4C is a cross sectional view of a juncture in the fuel pump component of FIG. 4B as viewed along 4C—4C.

FIGS. 4A and 4B are various views of another fuel pump component 140 having a barrel design used in a high pressure fuel injection system, the fuel pump component 140 including a juncture in accordance with the present invention to reduce the likelihood of fatigue failure. The fuel pump component 140 is merely a part of a fuel pump assembly (not shown) for pressurizing the fuel. The fuel pump component 140 includes a fuel pump body 142 having a plurality of mounting holes 144 that allows the fuel pump component 140 to be installed, for example, to the housing of the fuel pump assembly. The fuel pump component 140 also includes ports 146, only one of which is shown in FIG. 4A, for providing fluidic access to the fuel pump component 140, and fitting 147 that is received in a corresponding port of the fuel pump assembly. The fuel pump component 140 also includes a connector 148 that allows fluidic access to fuel in the fuel pump component 140. FIG. 4C is a cross sectional view of a juncture in the fuel pump component 140 of FIG. 4B as viewed along 4C—4C, while FIG. 4D is a cross sectional view of the juncture as viewed along 4D—4D.

As shown, the first passage 150 of the fuel pump component 140 is provided with groove 152 in which the second passage 156 is positioned so that the second passage 156 is fluidically connected to the first passage 150 via the groove 156, the passages defining the juncture of the present invention. In the manner previously described, the second passage 156 is positioned offset relative to the first passages 150 as most clearly shown in FIG. 4C. In the illustrated example, the groove 152 is annular in shape, the diameter of the first passage 150 being larger than the diameter of the second passage 156. Moreover, the groove 152 has a torus like shape having a dished curvature 153 as shown in FIG. 4D.

In addition, referring again to the cross sectional view of FIG. 4D, other passages are provided within the body 142 of the fuel pump component 140 which are implemented with the juncture of the present invention. In particular, a vertical passage 160 that extends through the fitting 147 intersects a cross passage 162 that provides fluidic communication between the ports 146, the vertical passage 160 and the cross passage 162 defining the juncture 166. As can be seen, the vertical passage 160 includes a groove 164, and the cross passage 162 is positioned in the groove 164 while being offset from the vertical passage 160. Furthermore, the cross passage 162 passes substantially straight through the vertical passage 160 so that the segments of the cross passage 162 are not diametrically opposed, but are instead, positioned toward one side of the vertical passage 160.

Thus, the juncture in accordance with the present invention may be implemented in any appropriate manner in a high pressure fuel system such as in the fuel pump component 140 shown. As previously described, such juncture in accordance with the present invention may be used to reduce the likelihood of fatigue failure. In the above regard, the fuel pump component 140 and correspondingly, the junctures 166 provided therein, may be made of an alloy steel containing by weight, up to 5.5% chromium, 1.5% molybdenum, and/or 1.0% vanadium, which is preferably heat treated and gas nitrided as described previously relative to the common rail. However, in other embodiments, other materials may be used instead.

As previously noted, the above implementations of the junctures and the grooves provided in the junctures of the high pressure fuel system are merely examples and the present invention may be implemented using different juncture and/or groove geometries and in different applications such as in common rails, fuel pump components, or fuel injectors. In particular, in implementations where only one second passage is fluidically connected to the groove of the first passage, the groove need not be annular or have a torus shape.

Figure 5:
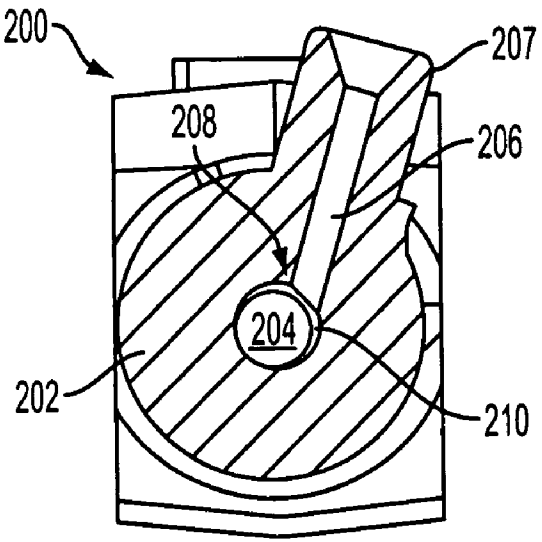
FIG. 5 is a cross sectional view of a juncture in accordance with another embodiment of the present invention in which the groove peripherally circumscribes only a portion of the first passage.

FIG. 5 is a cross sectional view of a common rail 200 such as that shown in FIG. 1A in accordance with another embodiment, the common rail 200 having a common rail body 202 with a first passage 204 extending therethrough. As can be seen, a second passage 206 of connector 207 intersects the first passage 204 at juncture 208 in accordance with the present invention. In this embodiment, the first passage 204 is provided with a groove 210 that is not annular in shape, but is crescent shaped. As can be seen, the groove 210 only partially circumscribes the periphery of the first passage 204.

The second passage 206 is positioned in the groove 210 to fluidically connect to the first passage 204. It is also noted that the groove 210 does not have a torus like shape with a dished curvature. Of course, in other embodiments, a non-annular groove having such a curvature may be provided as well. The groove 210 having the crescent shape as described has also been found to also effectively reduce the stress caused by the pressure cycling so that the likelihood of fatigue failure in the common rail 200 is also reduced. The present implementation of the groove 200 in the first passage as shown in FIG. 5 is especially advantageous in those situations where not enough material is available to allow a full annular groove such as the groove shown in FIG. 1C.

Figure 6:
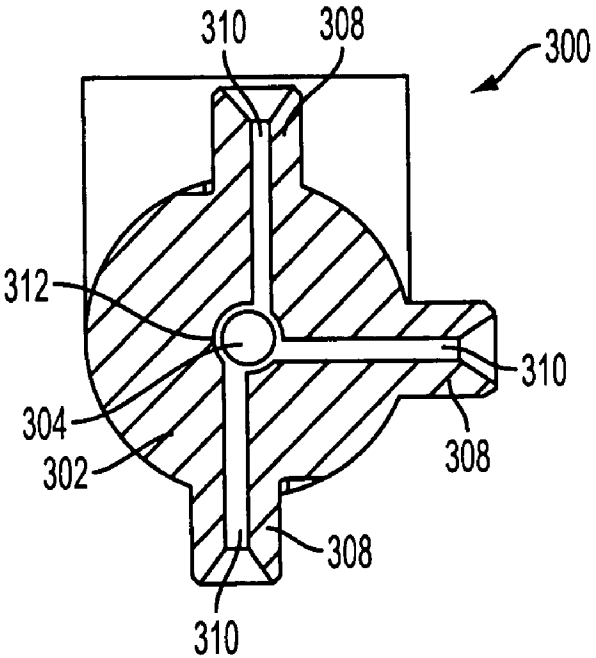
FIG. 6 is a cross sectional view of three junctures of a common rail in accordance with another embodiment.

FIG. 6 is a cross sectional view of a common rail 300 such as that shown in FIG. 2C in accordance with another embodiment, the common rail 300 having a common rail body 302 with a first passage 304 extending there through. As can be seen, plurality of connectors 308 (three junctures 308) are provided on the common rail body 302 which define junctures in accordance with the present invention. The connectors 308 include second passages 310 which intersect the first passage 304 via groove 312 provided in the first passage 304 in a manner previously described. In particular, the second passages 310 are positioned transversely offset relative to the first passage 304 so that the central axis extending through the second passages 310 do not intersect the longitudinal axis of the first passage 304. Again, whereas a particular configuration of the present invention is described relative to FIG. 6, it should be evident that the present invention may be implemented differently as well.

In view of the discussion above, it should also be evident that another aspect of the present invention is in providing a method for increasing resistance to fatigue failure in a high pressure fuel injection system. In particular, a method is provided in which a juncture that is adapted to changing direction of fuel flow includes a groove for reducing the likelihood of fatigue failure. The method includes the steps of providing a first passage having a longitudinal axis extending therethrough, and providing an annular groove positioned along a portion of the longitudinal axis of the first passage. The method further includes the steps of providing a second passage having an opening, and providing the opening of the second passage in the annular groove to allow fluidic communication between the second passage and the first passage.

In accordance with another embodiment of the method, the method further includes the step of offsetting the opening of the second passage transversely in the annular groove so that a central axis of the second passage does not intersect the longitudinal axis of the first passage. Additional steps of heat treating and/or gas nitriding the juncture may be provided to further minimize the likelihood of fatigue failure in the juncture.

Again, it should be noted that whereas in the illustrated embodiment, the juncture and method for reducing likelihood of fatigue failure has been applied to a common rail and to components of a fuel pump, the present invention is not limited thereto. In this regard, the present invention may be effectively implemented to any junctures of the fuel passages of a high pressure fuel system such as in a fuel injector, in which the direction of the fuel flow is changed or otherwise distributed.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. A juncture for changing direction of fuel flow in a high pressure fuel injection system that is adapted to provide high pressure fluid to an internal combustion engine, said juncture comprising:

a juncture body made of an alloy steel;

a first passage formed in said juncture body, said first passage having a first diameter and a longitudinal axis extending therethrough, said first passage including a groove positioned along a portion of said longitudinal axis and having an annular shape with a diameter larger than a diameter of said first passage to peripherally circumscribe said first passage; and a second passage formed in said juncture body, said second passage having a second diameter, a central axis extending therethrough, and an opening, said opening of said second passage being provided in said groove of said first passage to allow fluidic communication between said second passage and said first passage;

wherein said opening of said second passage is transversely offset in said groove so that said central axis of said second passage does not intersect said longitudinal axis of said first passage, and said alloy steel comprises by weight, up to 5.5% chromium, up to 1.5% molybdenum, and up to 1.0% vanadium.

2. The juncture of claim 1, wherein said groove has a dished curvature.

3. The juncture of claim 1, wherein said second passage is at least two second passages, each having an opening that is positioned in said groove.

4. The juncture of claim 3, wherein said at least two second passages are transversely offset in said groove.

5. The juncture of claim 3, wherein said at least two second passages are positioned in said groove opposite to one another.

6. The juncture of claim 1, wherein said alloy steel is treated through a heat treatment cycle to provide a hardened martensitic core.

7. The juncture of claim 1, wherein said alloy steel is gas nitrided to provide a surface with enriched nitrogen content and hard surface layer having residual compressive stresses.

8. The juncture of claim 1, wherein said high pressure fuel injection system includes a common rail, said juncture being provided in said common rail.

9. A common rail for providing high pressure fuel to fuel injectors of an internal combustion engine, said common rail comprising:

a common rail body made of an alloy steel;

a first passage formed in said common rail body, said first passage having a first diameter and a longitudinal axis extending therethrough, said first passage including a groove positioned along a portion of said longitudinal axis of said first passage; and a second passage formed in said common rail body, said second passage having a second diameter, a central axis extending therethrough, and an opening, said opening of said second passage being provided in said groove of said first passage to allow fluidic communication between said second passage and said first passage;

wherein said alloy steel comprises by weight, up to 5.5% chromium, up to 1.5% molybdenum, and up to 1.0% vanadium.

10. The common rail of claim 9, wherein said groove peripherally circumscribes at least a portion of said first passage.

11. The common rail of claim 10, wherein said groove partially circumscribes said first passage and is crescent shaped.

12. The common rail of claim 10, wherein said first passage is substantially circular in cross section and said groove is annular in shape, said groove having a groove diameter larger than said first diameter of said first passage.

13. The common rail of claim 9, wherein said groove has a dished curvature.

14. The common rail of claim 9, wherein said opening of said second passage is transversely offset in said groove so that said central axis of said second passage does not intersect said longitudinal axis of said first passage.

15. The common rail of claim 9, wherein said second passage is at least two second passages, each having an opening that is positioned in said groove.

16. The common rail of claim 15, wherein said at least two second passages are transversely offset in said groove.

17. The common rail of claim 16, wherein said at least two second passages are positioned in said groove opposite to one another.

18. The common rail of claim 9, wherein said alloy steel is treated through a heat treatment cycle to provide a hardened martensitic core.

19. The common rail of claim 9, wherein said alloy steel is gas nitrided to provide a surface with enriched nitrogen content and hard surface layer having residual compressive stresses.

20. A method for increasing resistance to fatigue failure in a juncture of a high pressure fuel injection system that is adapted to change direction of fuel flow in the high pressure fuel injection system, said method comprising the steps of:

providing a body made of an alloy steel comprising by weight, up to 5.5% chromium, up to 1.5% molybdenum, and up to 1.0% vanadium;

providing a first passage in said body, said first passage having a longitudinal axis extending therethrough;

providing a groove positioned along a portion of said longitudinal axis of said first passage;

providing a second passage in said body, said second passage having an opening; and positioning said opening of said second passage in said groove to allow fluidic communication between said second passage and said first passage.

21. The method of claim 20, further including the step of offsetting said opening of said second passage on a circumference of said groove so that a central axis of said second passage does not intersect said longitudinal axis of said first passage.

22. The method of claim 20, further including the step of providing another second passage in said body having an opening that is also positioned in said groove.

23. The method of claim 22, further including the step of positioning said second passages transversely offset in said groove and opposite to one another.

24. The method of claim 22, further including the step of heat treating said juncture to provide a hardened martensitic core.

25. The method of claim 22, further including the step of gas nitriding said juncture to provide a surface with enriched nitrogen content and hard surface layer thereon.

26. The method of claim 22, wherein said high pressure fuel injection system includes a common rail, said juncture being provided in said common rail.

27. The method of claim 20, further including the step of positioning said second passage transversely offset in said groove and opposite to one another.

28. The method of claim 20, further including the step of heat treating said juncture to provide a hardened martensitic core.

29. The method of claim 20, further including the step of gas nitriding said juncture to provide a surface with enriched nitrogen content and hard surface layer thereon.

* * * * *